US006253854B1

(12) United States Patent
Fenton

(10) Patent No.: US 6,253,854 B1
(45) Date of Patent: Jul. 3, 2001

(54) EMERGENCY WELL KILL METHOD

(75) Inventor: Stephen Paul Fenton, Inverurie (GB)

(73) Assignee: ABB Vetco Gray, Inc., Houston, TX (US)

( * ) Notice: Subject to any disclaimer, the term of this patent is extended or adjusted under 35 U.S.C. 154(b) by 0 days.

(21) Appl. No.: 09/506,221

(22) Filed: Feb. 17, 2000

Related U.S. Application Data

(60) Provisional application No. 60/121,988, filed on Feb. 19, 1999.

(51) Int. Cl.[7] ..... E21B 33/076; E21B 43/12

(52) U.S. Cl. ..... 166/364; 166/363

(58) Field of Search ..... 166/364, 363, 166/90.1

(56) References Cited

U.S. PATENT DOCUMENTS

| | | | | |
|---|---|---|---|---|
| 3,602,303 | * | 8/1971 | Blenkarn et al. | 166/360 |
| 4,234,043 | | 11/1980 | Roberts . | |
| 4,320,804 | | 3/1982 | Brooks . | |
| 4,436,157 | | 3/1984 | Brooks . | |
| 4,494,609 | * | 1/1985 | Schwendemann | 166/336 |
| 4,658,904 | | 4/1987 | Doremus et al. . | |
| 4,685,521 | | 8/1987 | Raulins . | |
| 4,726,424 | | 2/1988 | Raulins . | |
| 4,880,060 | | 11/1989 | Schwendemann et al. . | |
| 5,544,707 | * | 8/1996 | Hopper et al. | 166/382 |
| 5,575,336 | | 11/1996 | Morgan . | |
| 5,819,852 | * | 10/1998 | Cunningham et al. | 166/345 |
| 5,860,478 | * | 1/1999 | Coutts et al. | 166/356 |
| 5,868,204 | | 2/1999 | Pritchett et al. . | |
| 5,894,890 | * | 4/1999 | Garcia-Soule et al. | 166/356 |
| 5,941,310 | * | 8/1999 | Cunningham et al. | 166/345 |
| 6,186,237 | * | 2/2001 | Voss, Jr. et al. | 166/337 |

FOREIGN PATENT DOCUMENTS

| | | | | |
|---|---|---|---|---|
| 1522741 | * | 8/1978 | (GB) | E21B/23/04 |
| 2212840 | * | 8/1989 | (GB) | E21B/34/06 |
| 2284838A | * | 6/1995 | (GB) | E21B/33/043 |

* cited by examiner

*Primary Examiner*—Hoang Dang
(74) *Attorney, Agent, or Firm*—James E. Bradley; Bracewell & Patterson, L.L.P.

(57) ABSTRACT

A method for installing a string of tubing in a subsea well has a provision for killing the well due to malfunction while the tubing is being installed. A running tool is attached to a tubing hanger located at the upper end of the string of tubing. A completion safety module secures to the running tool and to a monobore running string. The assembly is lowered through a riser into the well, with the tubing hanger landing in a production tree. After the tubing hanger has been secured to the tree, earth formation pressure is communicated to the interior of the string of tubing while the running tool still remains connected to the tubing hanger. If a problem occurs, and the valves of the completion safety module fail to open, rams of the riser blowout preventer are closed around the running tool. The running tool is then disconnected from the tubing hanger and allowed to move upward a short distance due to pressure in the well. Then, a kill fluid is pumped down a choke-and-kill line into the riser at a point below the rams. The kill fluid flows through the flow path between the running tool and the tubing hanger and down the string of tubing to kill the well.

12 Claims, 4 Drawing Sheets

EMERGENCY WELL KILL METHOD

This application claims the benefits of provisional application Ser. No. 60/121,988, filed Feb. 19, 1999.

TECHNICAL FIELD

This invention relates in general to a method for installing a string of production tubing in subsea well, and particularly to a method wherein the string of tubing is lowered on a monobore conduit and a malfunction necessitates killing of the well during the installation and testing.

BACKGROUND ART

In one type of offshore oil and gas production, the christmas tree or production tree will be located at the subsea floor. One type of production tree, referred to as a horizontal tree, has a landing shoulder for a tubing hanger, and both the tubing hanger and the tree have lateral production flow passages that register.

While completing the well with a horizontal tree, a riser extends from the production tree to a floating vessel at the surface. Production tubing is attached to a tubing hanger and lowered from the vessel into the well during completion. A running tool secures to the tubing hanger, and a completion safety module, also commonly referred to as a subsea test tree forms a part of the running tool assembly. The assembly is lowered on a monobore conduit, such as drill pipe.

After the tubing hanger lands, the well is perforated by running a perforating gun through the tubing string. The subsea test tree has valves to open and close the monobore conduit for testing the well. After testing is completed, the valves of the subsea test tree are opened and a plug is lowered on a wireline through the monobore conduit and landed in the upper portion of the tubing hanger to block the vertical passage through the tubing hanger. The operator then detaches the running tool from the tubing hanger, retrieves the running tool, subsea test tree and monobore conduit to the surface. A tree cap then is lowered and landed in the bore of the production tree above the tubing hanger. The riser is disconnected from the tree. Production flows out the lateral flow passage.

It is possible for an emergency to occur while the tubing is being installed in the well. For example, the valves in the subsea test tree may malfunction and not be able to open. The downhole safety valve, which is a valve located in the tubing string below the tubing hanger, may be leaking or mechanically prevented from closure by objects in the tubing. Under such an emergency, the operator will likely need to kill the well, which is to load the tubing with a heavy enough fluid such that no pressure will exist at the surface. However, it may not be possible to pump directly down the monobore conduit because ofthe malfunctioning subsea test tree valves. In the prior art, subsea test trees have been employed that utilize valves that allow the operator to pump down the monobore conduit past the valves even though closed. These types of valves are considered to have potential have drawbacks as to reliability, however, due to a greater possibility of particulate ingress between seals and mating surfaces.

DISCLOSURE OF INVENTION

In this invention, if a malfunction occurs, the rams of the blowout preventer of the riser would be closed around the running tool assembly. Then, the connector of the running tool assembly is disconnected from the tubing hanger in a controlled manner. The running tool assembly is moved upward a short distance, typically due to pressure in the tubing string. The upward movement is limited by a stop shoulder provided on the running tool assembly below the set of rams in the blowout preventer. The stop shoulder engages the rams, stopping upward movement, but allowing a flowpath to exist between the tubing hanger and the running tool assembly from the outside.

Then, the operator pumps a kill fluid down a choke-and-kill line. The choke-and-kill line extends alongside the riser and leads into the riser at a point below the rams. The kill fluid flows down the tubing to kill the well. When the well is under control, the running tool assembly may be retrieved to the surface for repair or replacement.

DETAILED DESCRIPTION OF THE DRAWINGS

Figure 1:
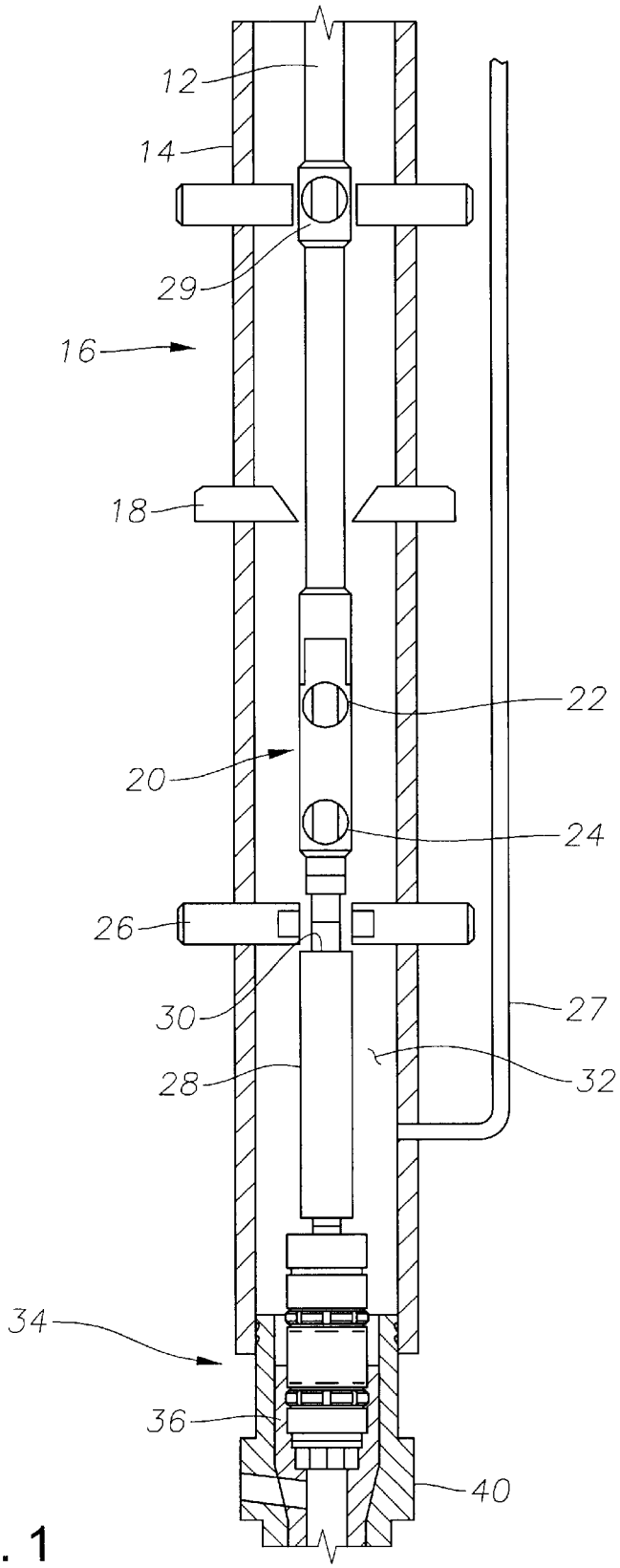
FIG. 1 is a schematic view of a running tool assembly installing a tubing hanger in a subsea production tree.

Referring now to FIG. 1, a monobore conduit 12, typically casing or tubing, has been lowered from a floating vessel through a riser 14. A conventional blowout preventer (BOP) 16 is attached to the lower end of riser 14. BOP 16 has multiple closure devices, including an annular closure member (not shown), at least one set of pipe rams 26, and a set of shear rams 18.

A running tool assembly on the lower end of running string 12 includes a completion safety module (CSM) 20, which will be below BOP shear rams 18 while in the landed or operating position. CSM 20 is a tubular member with a vertical passage. CSM 20 has an upper valve 22 and a lower valve 24, normally ball valves. Upper valve 22 and lower valve 24 are below BOP pipe rams 26 while CSM 20 is in the landed position. Riser 14 includes a choke-and-kill line 27 that extends alongside riser 14 and enters riser 14 below BOP pipe rams 26. An emergency disconnect and riser containment valve assembly 29 (RCV) is located in string 12 above CSM 20. Valves 22, 24 in CSM 20 are hydraulically actuated remotely from the vessel. An umbilical line (not shown) extends alongside running string 12 for supplying hydraulic pressure. The umbilical line enters the running tool assembly at a point located above pipe rams 26.

The running tool assembly includes a cylindrical, tubular adapter 28 affixed to the lower end of CSM 20 below BOP pipe rams 26. On an upper end of adapter 28 is a stop shoulder 30. If closed, BOP pipe rams 26 limit upward axial movement of drill string 12 because stop shoulder 30 of adapter 28 contacts BOP pipe rams 26. Pipe rams 26 are sized to close and form a seal on a smooth cylindrical portion of the running tool assembly directly above shoulder 30. When pipe rams 26 are closed around the running tool assembly, a pressure chamber 32 below the BOP pipe rams 26 exists.

Figure 2:
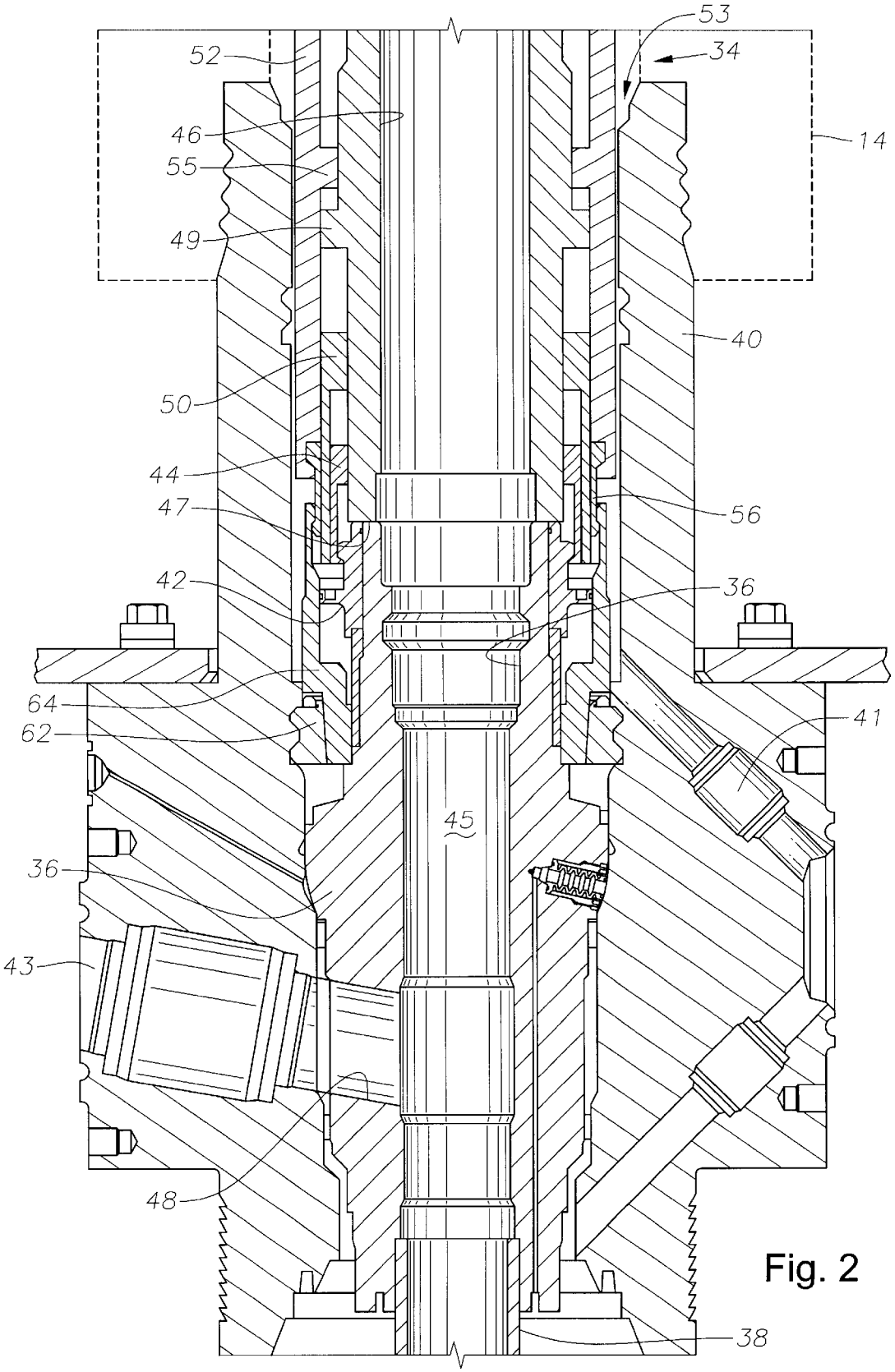
FIG. 2 is an enlarged cross-sectional view of a lower portion of the running tool assembly of FIG. 1, shown connected to the tubing hanger.
Figure 3:
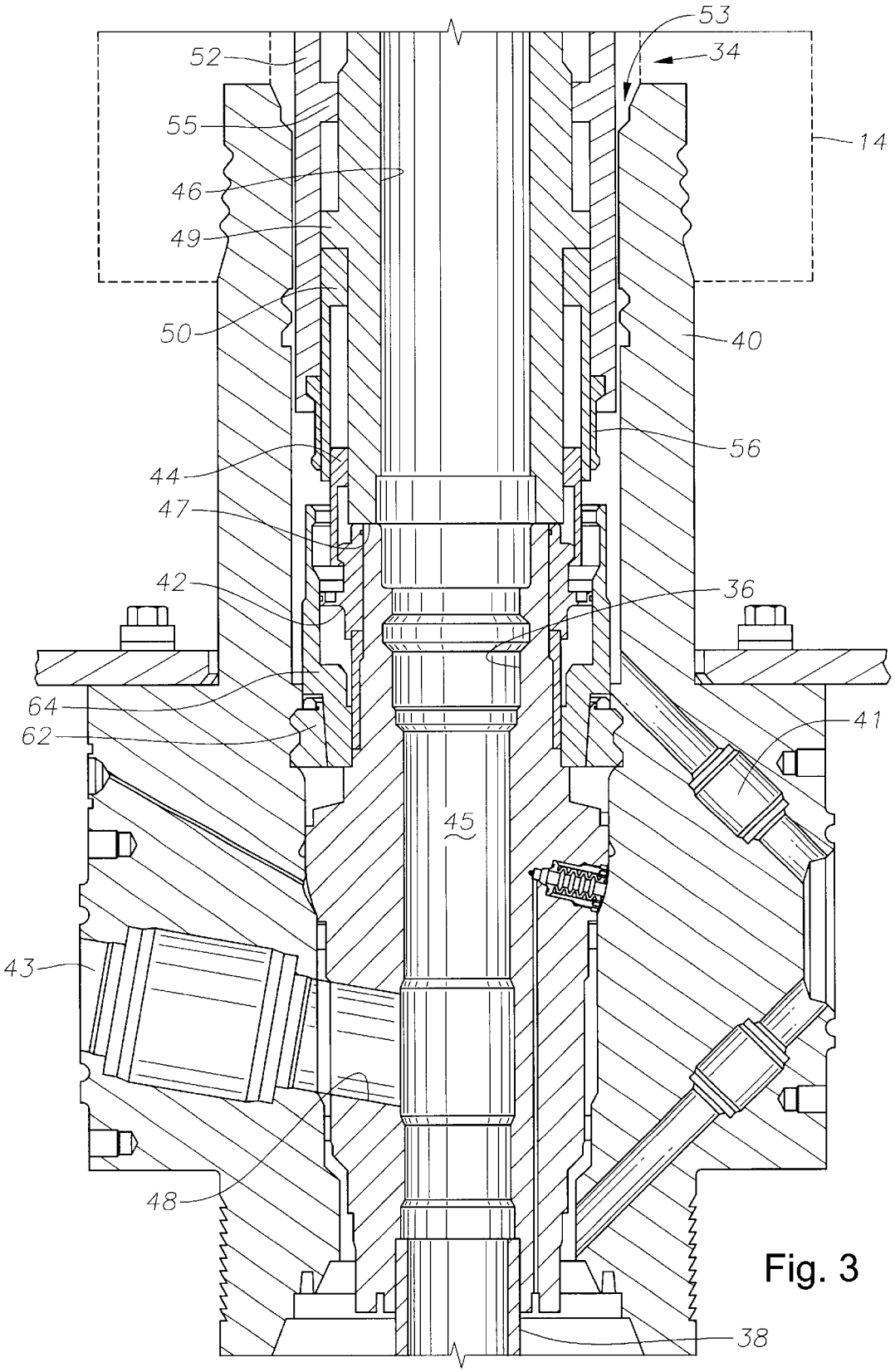
FIG. 3 is an enlarged cross-sectional view of the running tool assembly as shown in FIG. 2, but showing the running tool being disconnected from the tubing hanger.

The running tool assembly includes a running tool 34 located below adapter 28. Running tool 34 is detachably connected to a tubing hanger 36, which is secured to the upper end of a string of tubing 38 (FIG. 2). A downhole safety valve (not shown) will be located in the string of the tubing 38. Tubing hanger 36 lands within a christmas or production tree 40, which is part of a wellhead assembly located at the sea floor. Referring to FIG. 2, tree 40 is of a type known as a "horizontal" tree, which has a bore for receiving tubing hanger 36 and a lateral production flow outlet 43. Tree 40 has a tubing annulus bypass passage 41, which bypasses tubing hanger 36 and has valves (not shown) for opening and closing passage 41. A cross-over line (not shown) will selectively connect tubing annulus bypass passage 41 to production passage 43. Annulus bypass 41 communicates with the annulus surrounding the string of tubing 38. Tubing hanger 36 has a single axial passage 45 and a lateral flow outlet 48 leading from axial passage 45 and registering with tree outlet 43.

Referring still to FIG. 2, an enlarged view of running tool 34, tubing hanger 36, and horizontal tree 40 is shown. Tubing hanger 36, shown landed within tree 40, has a connector sleeve 42 secured by threads to its upper end so as to form a part of tubing hanger 36. Running tool 34 is conventional, having a body 46 that carries an inward facing collet 44 for engaging an exterior profile on connector sleeve 42. A downward facing shoulder 47 on a lower end of body 46 engages an upper rim of tubing hanger 36. The depending fingers of collet 44 are deflected inward by axial movement of an inner surface of a latching piston 50. Latching piston 50 is carried on body 46 below an annular piston 49 stationarily formed on body 46, defining a pressure chamber above latching piston 50.

An outer sleeve 52 surrounds inner body 46 and latching piston 50. Outer sleeve 52 has a piston 55 stationarily formed on its inner diameter that sealingly engages the outer diameter of body 46. Outer sleeve piston 55 is located above body piston 49, defining a pressure chamber between outer sleeve 52 and body 46. The outer surface of outer sleeve 52 is smaller in diameter than the bore of horizontal tree 40, defining a running tool annulus 53. A lower end of outer sleeve 52 retains an outward facing collet 56. A lower end of outwardly facing collet 56 engages an inner profile of a cam member 64. Tubing hanger 36 is secured within tree 40 by a lock ring 62. Lock ring 62 is activated and deactivated by downward and upward movement of cam member 64, which in turn is moved upward and downward by outward facing collet 56. Cam member 64 remains with tubing hanger 36 after installation.

In operation, first the well will be drilled and cased. Tree 40 will then be run on the lower end of riser 14, with BOP 16 and riser 14 extending upward from tree 40 to the drilling rig. Then, tubing 38 (FIG. 2) is run on running string 12, using running tool 34 and CSM 20. After landing tubing hanger 36, running tool outer sleeve 52 is stroked downward relative to body 46 by supplying hydraulic pressure through an umbilical line (not shown) from the drilling rig to running tool 34. The pressure acts in a chamber above outer sleeve piston 55 between outer sleeve 52 and body 46, causing cam member 64 to move downward, wedging lock ring 62 into engagement with a grooved profile in the bore of tree 40. This is the position shown in FIG. 2.

Then a perforating gun (not shown) is typically run through tubing 38 on wireline to perforate the well. The perforating gun is then removed and the well is tested. Valves on CSM 20 are open and closed during the testing procedure. Typically, a wireline plug (not shown) is then run through running string 12 and set in axial bore 45 of tubing hanger 36. Running tool 34 is then disconnected by supplying hydraulic pressure from the drilling rig to a chamber below the head of latching piston 50 between latching piston 50 and body 46, causing latching piston 50 to move upward. This movement allows collet 44 to move outward, disconnecting its fingers from the profile in sleeve 42. The operator supplies hydraulic fluid pressure to the chamber below outer sleeve piston 55, causing outer sleeve 52 to move upward relative to cam member 64. The upper position of latching piston 50 allows the depending fingers of collet 56 to spring inward, freeing running tool 34 from cam member 64. The operator retrieves running tool 34 along with running string 12. Cam member 64 remains with tubing hanger 36, holding lock ring 62 in the locked position.

The well will be under formation pressure once perforated. This results in pressure in the CSM 20 and in running string 12. A problem may arise that necessitates killing the well to balance formation pressure. Because of a malfunction, it may not be possible to open ball valves 22, 24 of the CSM 20, preventing the operator from running a wireline plug into bore 45 of tubing hanger 36. The downhole safety valve may be leaking or fail to close, necessitating well kill and its retrieval. Preferably, valves 22,24 may or may not be of a type that would enable the operator to pump down running string 12 with heavy fluid to kill the well while valves 22, 24 remain closed. Irrespective, the ability to pump through may be compromised or disabled due to malfunction and/or debris intrusion.

Figure 4:
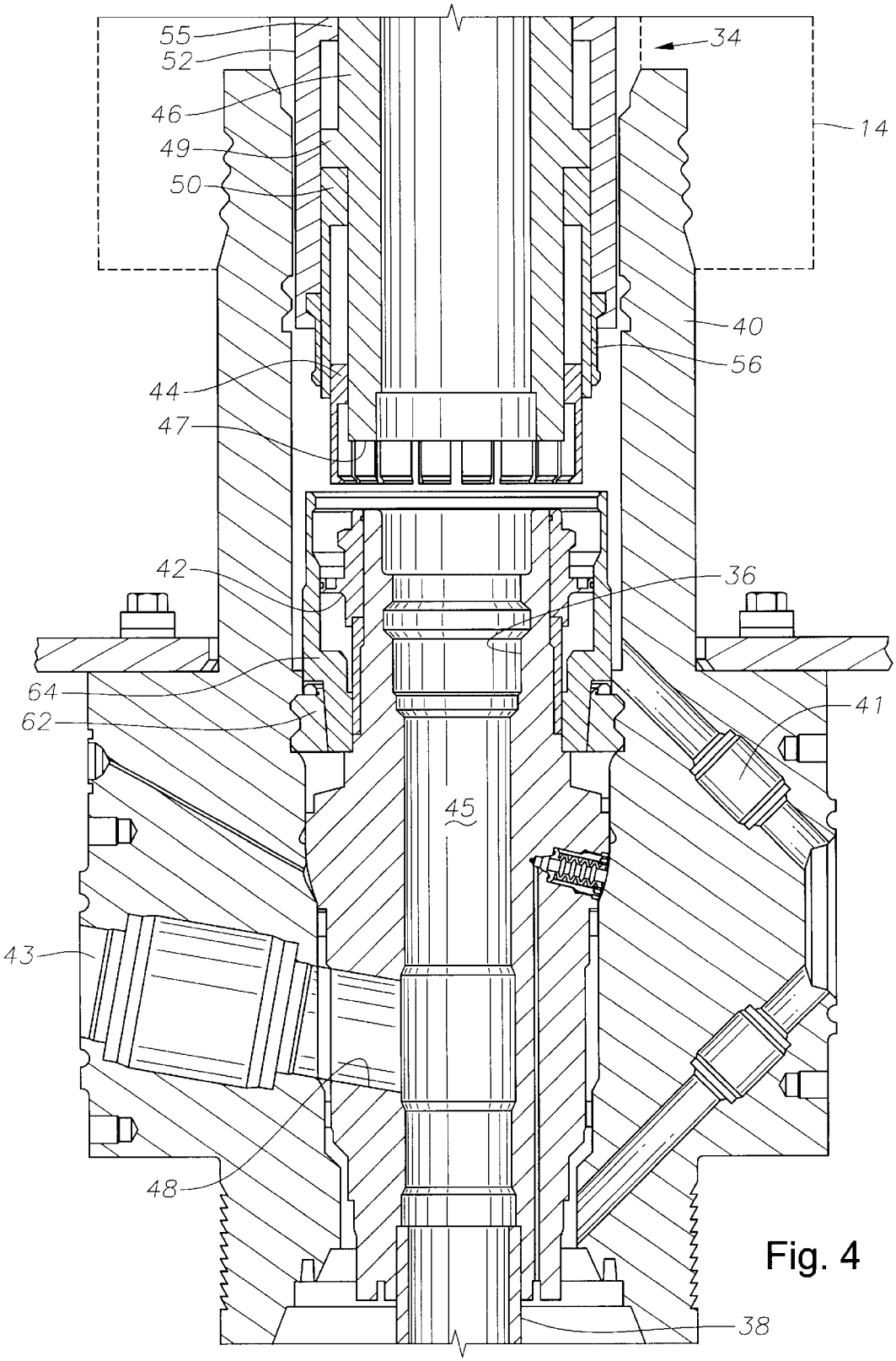
FIG. 4 is an enlarged cross-sectional view of the running tool assembly as shown in FIG. 3, but showing the running tool assembly elevated above the tubing hanger to allow well kill fluids to bypass the running tool.

The method of establishing well safety in this invention includes the emergency provision of first closing BOP pipe rams 26 around a portion of running tool 34 above shoulder 30. This creates sealed annular chamber 32 around running tool 34 in riser 14 above tree 40. Then tubing hanger running tool 34 is disconnected from tubing hanger 36 in the same manner as explained above. Raising latching piston 50 allows a lower end of inwardly facing collet 44 to pivot outwardly out of engagement with connector sleeve 42 on tubing hanger 36. After releasing the connection between outwardly facing collet 56 and cam member 64, high pressure within tubing 38 will normally force running tool 34 upwards. Running tool 34 is free to move upward, typically 3–4 inches, until stop shoulder 30 on adapter 28 contacts pipe rams 26. FIG. 4 shows running tool 34 moved upward relative to tubing hanger 36. This creates a gap between the upper end of tubing hanger 36 and downward facing shoulder 47 of running tool 34. If inadequate pressure exists in the well to push running tool 34 upward, the operator may raise it by pulling upward on running string 12.

After tubing hanger running tool 34 moves upward relative to tubing hanger 36, then running tool annulus 53 may be used to transfer kill fluids pumped down through choke and-kill line 27. The kill fluid passes through choke-and-kill line 27 into chamber 32, through tubing hanger running tool annulus 53, and past mating surface 47 of body 46 bullheading into tubing 38. The operator then establishes that enough kill fluid is in the tubing 38 such that no back flow is occurring up choke and kill line 27.

After the well has been killed, the operator may then open pipe rams 26 and retrieve running string 12, CSM 20 and running tool 34. BOP 16 will be closed during retrieval of running string 12. After repair or replacement of valves 22, 24 in CSM 20, the operator will preferably run running tool 34 again and re-establish engagement of tubing hanger running tool 34 with tubing hanger 36 in order to resume operations. If repair is also needed to the downhole safety valve, then this could be conducted at this time, the procedure being dependent on type (wireline or tubing retrievable). Subsequently, the kill fluid may then be circulated out of the well to reestablish formation pressure in running tool 34 and running string 12. The operator will then set a wireline plug in tubing hanger bore 45 so as to be able to disconnect and retrieve running tool 34.

The method of the invention has several advantages. The method may be used when an emergency shut-in is implemented by a malfunction of the CSM, and there exists an inability to re-open the CSM valves to effect well control due to mechanical damage or debris blockage. Furthermore, the downhole safety valve may be leaking badly, preventing the operator from relying on its closure to allow safe retrieval of the CSM. The method of the invention allows the operator to pump kill fluid into the tubing string under these circumstances to enable recovery of a CSM. It is not necessary to have a CSM of the type that has a means to allow downward pumping of kill fluid past the ball valves. Even if such a pump-through test tree is used, this method allows the operator to kill the well in the event that the such a pump-through test tree is heavily contaminated with sediment or scale in the ball and seats, making pump-through for killing the well ineffective. The method allows the operator to use a non-pump through CSM, which is generally considered more reliable.

Although the invention has been shown in only one of its forms, it should be apparent to those skilled in the art that it is not so limited, but is susceptible to changes without departing from the scope of the invention. For example, a variety of tubing hanger running tools may be employed.

I claim:

1. A method for installing a string of tubing within a well having a tubing hanger that lands within a wellhead assembly, the wellhead assembly being secured to a string of riser having a blowout preventer with a set of rams and a choke and kill line extending alongside the riser and into the riser at a point below the set of rams, the method comprising:

(a) securing a running tool assembly to the tubing hanger and lowering the running tool assembly and string of tubing through the riser with a running string;

(b) with the assistance of the running tool assembly, landing and securing the tubing hanger in the wellhead assembly;

(c) communicating earth formation pressure to an interior of the string of tubing while the running tool assembly remains connected to the tubing hanger; and in the event that it is desired to kill the well, (d) closing the rams around the running tool assembly; then while keeping the rams closed;

(e) disconnecting the running tool assembly from the tubing hanger, creating a flow path between the tubing hanger and the running tool assembly; and then (f) pumping a kill fluid down the choke and kill line into the riser, through the flow path and into the string of tubing to kill the well.

2. The method according to claim 1, wherein in step (e) the flow path is created by formation pressure pushing upward on the running tool assembly.

3. The method according to claim 1, wherein step (a) further comprises providing an upward facing shoulder in the running tool assembly, the shoulder being located such that it is positioned below the set of rams when the tubing hanger has landed in step (b); and step (e) comprises:

creating the flow path by moving the running tool assembly upward relative to the tubing hanger until the shoulder contacts the set of rams.

4. The method according to claim 3, wherein the running tool assembly is moved upward due to formation pressure acting on the running tool assembly.

5. The method according to claim 1, wherein the running string of step (a) comprises a monobore string.

6. A method for installing a string of tubing within a well having a tubing hanger that lands within a production tree, the tubing hanger and production tree having lateral production flow passages, the production tree being secured to a string of riser having a blowout preventer with a set of rams and a choke and kill line extending alongside the riser and into the riser at a point below the set of rams, the method comprising:

(a) providing a tubing hanger running tool assembly with a tubing hanger connector and an upward facing shoulder spaced a selected distance above the connector;

(b) securing the connector of the running tool assembly to the tubing hanger and lowering the running tool assembly and the string of tubing through the riser on a running string;

(c) with the assistance of the running tool assembly, landing and securing the tubing hanger in the production tree with the upward facing shoulder located below the set of rams;

(d) communicating earth formation pressure to an interior of the string of tubing while the connector of the running tool assembly remains connected to the tubing hanger; and in the event that it is desired to kill the well due to a malfunction, (e) closing the rams around the running tool assembly; then while keeping the rams closed, (f) disconnecting the connector ofthe running tool assembly from the tubing hanger, allowing the formation pressure to push the running tool assembly upward relative to the tubing hanger, creating a flow path between the tubing hanger and the running tool assembly with the upward facing shoulder contacting the set of rams to limit the amount of upward movement of the running tool assembly; and then (g) pumping a kill fluid down the choke and kill line into the riser, through the flow path and into the string of tubing to kill the well.

7. The method according to claim 6, wherein step (a) further comprises:

providing the running tool assembly with a completion safety module having at least one valve that blocks flow through the conduit; and keeping the valve closed while performing steps (e), (f) and (g).

8. The method according to claim 6, wherein step (a) further comprises providing an exterior cylindrical surface on the running tool assembly extending upward from the upward facing shoulder; and wherein step (e) comprises:

closing the set of rams around the cylindrical surface.

9. The method according to claim 6, further comprising after step (g), retrieving the running tool assembly while leaving the tubing hanger in the tree, and repairing or replacing any malfunctioning components: then rerunning and reconnecting the connector of the running tool assembly with the tubing hanger and reestablishing pressure in the string of tubing.

10. A method for installing a string of tubing within a well having a tubing hanger that lands within a production tree, the tubing hanger and production tree having lateral production flow passages, the production tree being secured to a string of riser having a blowout preventer with a set of rams and a choke and kill line extending alongside the riser and into the riser at a point below the set of rams, the method comprising:

(a) providing a tubing hanger running tool assembly that includes a tubing hanger running tool and a completion safety module, and providing the tubing hanger running tool with a tubing hanger connector and an upward facing shoulder spaced a selected distance above the connector;

(b) securing the connector of the running tool to the tubing hanger;

(c) securing the completion safety module to the running tool and to a monobore running string, the completion safety module having a valve therein, and with the running string, lowering the running tool assembly through the riser;

(d) with the assistance of the running tool, landing and securing the tubing hanger in the production tree with the upward facing shoulder located below the set of rams;

(e) communicating earth formation pressure to an interior of the string of tubing and an interior of the completion safety module while the connector of the running tool remains connected to the tubing hanger; and in the event that it is desired to kill the well and the valve of the completion safety module fails to open, (f) closing the rams around the running tool assembly above the shoulder; then (g) disconnecting the connector ofthe running tool from the tubing hanger, allowing the formation pressure to push the running tool assembly upward relative to the tubing hanger, creating a flow path between the tubing hanger and the running tool, with the upward facing shoulder contacting the rams to limit the amount of upward movement ofthe running tool assembly; and then (h) pumping a kill fluid down the choke and kill line into the riser, through the flow path and into the string of tubing.

11. The method according to claim 10, wherein step (a) further comprises providing an exterior cylindrical surface on the running tool assembly extending upward from the upward facing shoulder; and wherein step (f) comprises:

closing the set of rams around the cylindrical surface.

12. The method according to claim 10, further comprising after step (h), retrieving the running tool assembly, leaving the tubing hanger in the tree, and repairing or replacing any malfunctioning components: then rerunning the running tool assembly, reconnecting the connector of the running tool with the tubing hanger, and reestablishing pressure in the string of tubing; then disconnecting the connector ofthe running tool from the tubing hanger and retrieving the running tool assembly.

* * * * *